United States Patent [19]

Hickey

[11] Patent Number: 4,557,198

[45] Date of Patent: Dec. 10, 1985

[54] SAFETY DEVICES FOR CARRIER SHELLS

[75] Inventor: Dennis J. Hickey, Accrington, England

[73] Assignee: The Secretary of State for Defence in Her Britannic Majesty's Government of the United Kingdom of Great Britain and Northern Ireland, London, England

[21] Appl. No.: 468,596

[22] Filed: Feb. 22, 1983

[30] Foreign Application Priority Data

Mar. 4, 1982 [GB] United Kingdom ..... 8206383

[51] Int. Cl.[4] ..... F42B 41/00

[52] U.S. Cl. ..... 102/481; 102/489

[58] Field of Search ..... 102/249, 247, 221, 275, 102/481, 489, 340, 342, 351, 357

[56] References Cited

U.S. PATENT DOCUMENTS

| | | | |
|---|---|---|---|
| 1,230,933 | 6/1917 | Simpson | 102/247 |
| 1,292,505 | 1/1919 | Newell | 102/247 |
| 2,454,281 | 11/1948 | Hicks | 102/489 |
| 2,595,757 | 5/1952 | Brandt | 102/481 |
| 3,173,364 | 3/1965 | Nordzell | 102/481 |
| 3,665,857 | 5/1972 | Radnich et al. | 102/481 |
| 4,022,130 | 5/1977 | Johnson et al. | 102/481 |
| 4,423,683 | 1/1984 | Telmo | 102/481 |

FOREIGN PATENT DOCUMENTS

| | | |
|---|---|---|
| 2131748 | 12/1972 | Fed. Rep. of Germany . |
| 721541 | 1/1955 | United Kingdom . |
| 1120610 | 7/1968 | United Kingdom . |

*Primary Examiner*—Harold J. Tudor

*Attorney, Agent, or Firm*—Cushman, Darby & Cushman

[57] ABSTRACT

A carrier shell for secondary projectiles having a shell casing, a plurality of secondary projectiles within the casing, an explosive dispersal charge for dispersing the projectiles and a safety device having a body closing a venting aperature in the casing. A first mechanical connection secures the body to the casing and yields on detonation of the charge before firing to vent any explosion before firing without dispersing the projectiles. A second mechanical connection is moved in response to firing to a condition preventing venting.

22 Claims, 8 Drawing Figures

SAFETY DEVICES FOR CARRIER SHELLS

Figure 1:
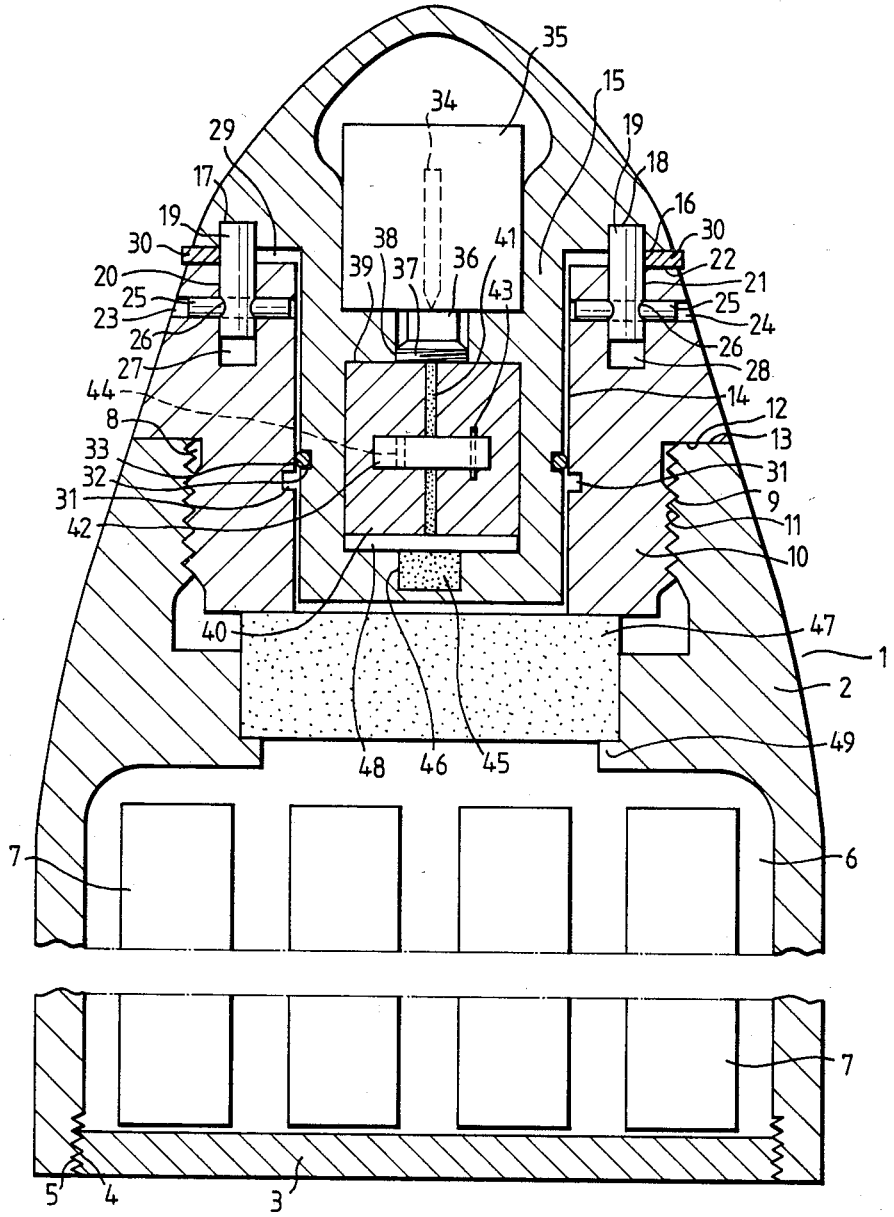

This invention relates to safety devices for carrier shells. Carrier shells are those which contain a plurality of secondary projectiles which are released at a predetermined moment after firing of the shell, either in flight or on impact with its target. The secondary projectiles are typically smoke or gas stores, flares, or may be explosive devices such as bomblets or minelets. There are many methods, well known to those skilled in the art, by which the release of the secondary projectiles can be effected. Thus the secondary projectiles may be released at a predetermined time after the firing of the shell, or after a certain deceleration of the shell. Alternatively proximity fuzes function on nearing a target or the fuze may be designed so as to function on impact. The arrangement is normally such that the secondary projectiles are automatically armed for firing on dispersal from the carrier shell.

It is essential for safety that the shell should be unarmed and therefore safe to handle, store, and load into the gun by which it is to be fired. This is ensured by the provision of a delayed arming unit, (DAU). The DAU serves to interupt the ignition train so that there is no continuous pathway between the detonator and the initiating charge until after the shell has been fired from the gun. Alternatively or additionally, detent means are provided which prevent a striker from contacting the detonator in the event of rough handling. This detent means operates until the shell is fired, when the striker is released in order to contact the detonator at the appropriate moment. DAU's which use masking shutters, springs, wires and other detent means are known to those skilled in the art and are commonly employed.

The secondary projectiles are normally ejected by a dispersal charge of explosive detonated at the appropriate moment. The danger therefore exists that if the temperature of the carrier shell is inadvertently raised eg by a fire where the shells are stored, the explosive charge may be ignited. Ignition of the explosive charge will explode the shell and scatter the secondary projectiles. The secondary projectiles will then become armed in the same way as if the shell had been fired from a gun, with the consequent danger to property and personnel. There thus exists a need to provide some means for preventing accidental dispersal of the secondary projectiles.

UK Pat. No. 1120610 describes a land mine which is provided with a plug formed from a material having a melting point lower than the detonation temperature of the explosive dispersal charge within the mine. In the event of a fire at an ammunition depot the plug will melt before the dispersal explosive ignites, thus providing an opening for the explosive to 'burn out' rather than explode the mine. It is usual for a shell to be stored without its fuze assembled and instead to be sealed by a plug or cap. This may possibly be such a plug of low melting point material and may conveniently include a hook or other handle by which the shell may be manoeuvred. It is therefore often necessary for the plug to be removed and replaced by the fuze before the shell is ready to be fired. This constitutes a time consuming and laborious operation especially disadvantageous when having to be carried out in hostile field conditions.

It is an object of the present invention to provide a safety device for a carrier shell which will ameliorate the effects of undesired detonation of the explosive dispersal charge, without suffering the disadvantages of the prior art device mentioned hereinbefore.

According to the present invention there is provided a safety device for a carrier shell of the type comprising a shell casing, a plurality of secondary projectiles contained within the casing, an explosive dispersal charge for dispersing the secondary projectiles from the casing, and a venting aperture in the casing through which the dispersal charge can vent without dispersing the secondary projectiles; said safety device having a body adapted to close the venting aperture and including first and second restraining means for restraining relative movement between the body and the shell casing, said first restraining means being releasable by detonation of the explosive charge and said second restraining means being actuable to restrain said relative movement and being capable of withstanding detonation of the explosive charge.

Conveniently the first restraining means comprises a shear pin forming at least part of a mechanical connection between the body and the shell casing, and having a shear strength such that it will yield on detonation of the explosive charge. If the explosive charge is detonated before the second restraining means is actuated, the shear pin will fracture and the body of the safety device is 'blown out' allowing the charge to vent through the venting aperture without dispersing the secondary projectiles. A convenient material for the shear pin is aluminium.

Preferably the second restraining means comprises first and second recesses, formed one in the body of the safety device and the other in the shell casing, and a locking member constrained within the first recess and actuable to move into the second recess to lock the body and casing one to the other. The locking member has a shear strength such that it is capable of withstanding detonation of the explosive dispersal charge and a particularly suitable material for the locking member is therefore high tensile steel. The first recess is preferably formed in the body and the second recess is formed in the shell casing. The locking member, when actuated, thereby moves outwardly assisted by the centrifugal forces from any rotation of the shell.

In one convenient arrangement the first and second recesses are initially longitudinally offset one from the other and relative movement between the body and the shell casing causes the two recesses to align, permitting movement of the locking member into the second recess to lock the body and the shell casing one to the other.

The first and second recesses are conveniently of annular form, and the locking ring is a split ring of a resilient material, the resilience of the locking member being such as to bias the locking member towards the second recess. Alternatively the first and second recesses are formed as bores, and the locking member is a shear pin. In this arrangement there is preferably provided resiliant means for biasing the locking member towards the second recess. If the shell is to spin in flight however, it may be sufficient for the centrifugal forces generated by the rotation to bias the locking member towards the second recess.

The shear pin constituting the locking member (herein referred to as the second shear pin) must have a shear strength sufficient to withstand detonation of the explosive charge unlike the shear pin constituting the first restraining means (herein referred to as the first shear pin). The second shear pin may conceivably be formed from a material different from that of the first shear pin so that the second pin has a relatively higher shear strength. More preferably the diameter of the second shear pin is greater than that of the first shear pin. This will endow the second shear pin with a high shear strength and permit it to withstand the forces generated by detonation of the explosive charge. Most preferably the second shear pin is integral with the first shear pin. There is conveniently provided a single shear pin which is moveable from a relatively small diameter portion constituting the first restraining means to a relatively larger diameter portion constituting the locking member of the second restraining means.

In one convenient arrangement the second restraining means is actuable in response to the shell exceeding a predetermined forward linear acceleration. The body of the safety device is conveniently moveable relative to the shell casing in response to the shell exceeding a predetermined forward linear acceleration, thereby to actuate the second restraining means.

The forces generated by the rapid acceleration of the shell on firing are commonly known as 'set back' forces. Where the first restraining means is a shear pin, its shear strength is preferably such that it will yield on set back of the body of the safety device during firing of the shell. The body is therefore moveable relative to the shell casing in response to the set back forces to actuate the second restraining means.

In an alternative arrangement the first and second recesses are initially aligned one with the other, and means are provided for holding the locking member in the first recess. The first and second recesses are conveniently formed as bores and the locking member is a shear pin. The holding means is conveniently a resilient bias opposing movement of the locking member into the first recess. Although a single spring arrangement is perfectly adequate, other arrangements including detents and catches may conceivably be employed.

The first and second restraining means may be separate members or, alternatively, the first restraining means may be a shear pin integral with the shear pin constituting the locking member. The first restraining means may conveniently carry a guide member which locates in the second recess, thereby to maintain alignment of the first and second recesses.

In an alternative arrangement the first and second recesses are of annular form and the locking member if a ring comprising actuate portions conjoined by weakened portions breakable to actuate the second restraining means In a convenient arrangement the second restraining means is actuable in response to the shell exceeding a predetermined angular velocity. Where the shell is designed to spin in flight the centrifugal forces thus generated may be used to actuate the second restraining means. The biasing means ensures that a relatively prolonged rotation of the shell is required to maintain the locking member in the second recess, thus locking the body and shell casing one to the other. The possibility of undesired actuation of the second restraining means, eg by sudden rotational impulses caused by jolting and rough handling, is therefore reduced.

In a preferred arrangement the body of the safety device is that of the fuze of the carrier shell. The fuze can therefore be fitted to the shell whilst in storage and yet the added safety of preventing accidental dispersion of the secondary projectiles is retained. The requirement for the fuse to be fitted at the gun is thereby eliminated.

There is conveniently provided an adaptor located between the body of the safety device and the shell casing, and adapted to receive the first and second restraining means. Where the body of the safety device is a fuze body, the adaptor allows interchangeability between fuzes incorporating safety devices according to the present invention, and more conventional fuzes. Conveniently the adaptor has an external screw thread engageable with a complementary internal screw thread on the shell casing. With the provision of such an adaptor safety devices according to the present invention may be fitted to existing carrier shells without the need for modification of the shell casing.

The invention also resides in a carrier shell incorporating a safety device as previously described.

Figure 2:
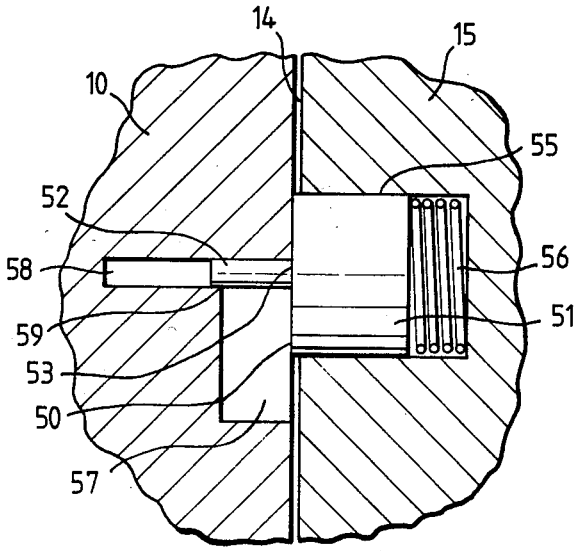
Figure 3:
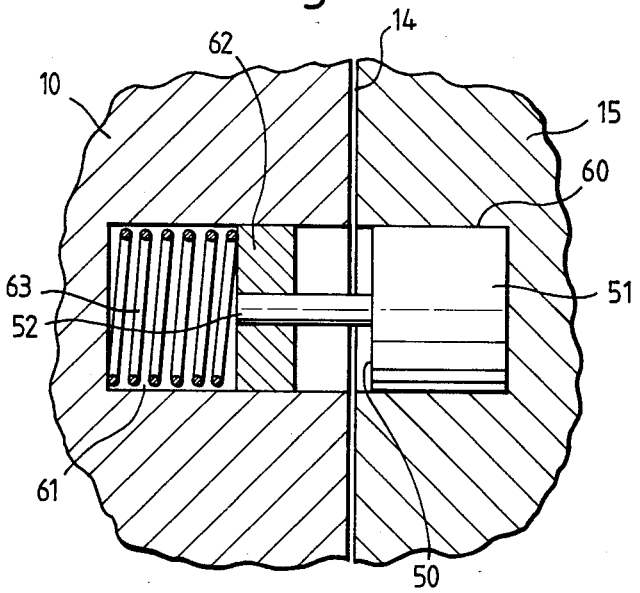
Figure 4:
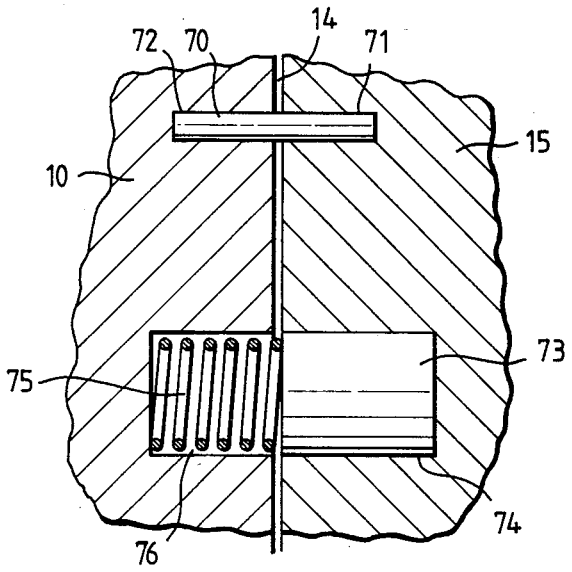
Figure 5:
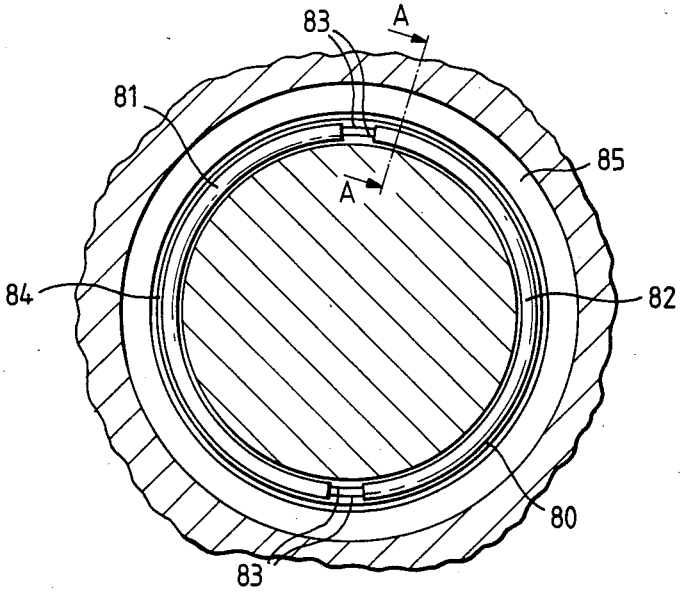
Figure 6:
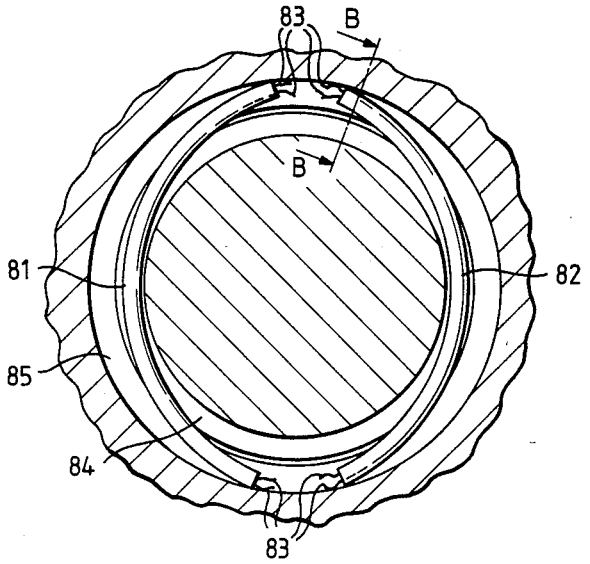
Figure 7:
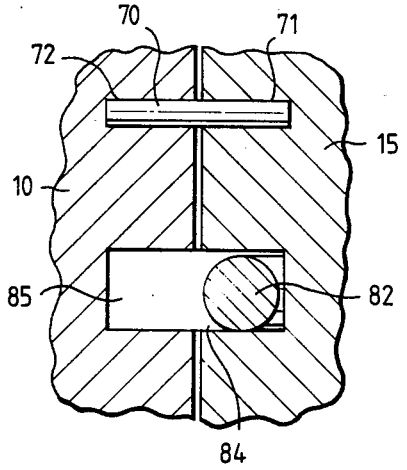
Figure 8:
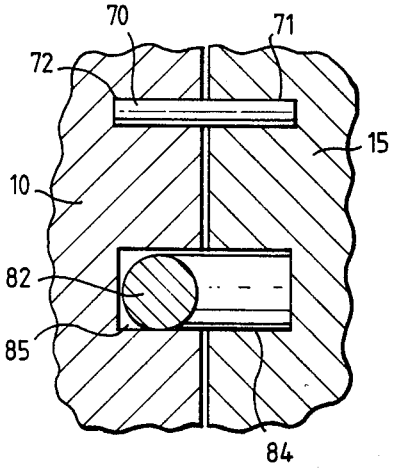

The invention will now be more specifically described, by way of example only, with reference to the accompanying drawings in which, FIG. 1 is a simplified sectional view of a carrier shell incorporating a safety device according to the present invention in the form of a blowout fuze, FIG. 2 is a view, shown partly in section, of a part of an alternative embodiment of safety device according to the invention, FIG. 3 is a similar view of part of a further alternative embodiment of safety device according to the invention, FIG. 4 is a similar view of part of a still further alternative embodiment of safety device according to the invention, FIG. 5 is a simplified plan view of part of a yet further alternative embodiment of safety device shown when in an unprimed condition, FIG. 6 is a simplified plan view of the part of the safety device of FIG. 5, shown when in a primed condition, FIG. 7 is a partial cross section along the line A—A of FIG. 5 as viewed in the direction of the arrows, and FIG. 8 is a partial cross section along the line B—B of FIG. 6 as viewed in the direction of the arrows.

FIG. 1 shows a carrier shell provided with a safety-device according to the present invention. The shell is indicated generally at 1 and comprises a hollow shell casing 2, sealed at its rear end by a plate 3 secured by means of complementary screw threads 4, 5 on the plate and casing respectively. The shell casing 2 defines a chamber 6 containing a plurality of projectiles 7 to be dispersed by the shell 1. The casing is provided at its forward and with a bore 8 having an internal screw thread 9.

An adaptor 10 having a complementary external screw thread 11 is screwed into the bore until an annular lip 12 firmly abuts the end face 13 of the shell casing 2. The adapter 10 has a central bore 14 in which is slideably received a fuze body 15 constituting the body of the safety device.

The fuze body 15 has an annular shoulder 16 in which there are formed two recesses 17, 18. Positively secured in each recess is a dowel pin 19 which extends rearwardly and is received in bores 20, 21 provided in the end face 22 of the adaptor 10. The adaptor 10 further contains two radially extending bores 23, 24 into each of which is introduced a shear pin 25, typically of aluminium. Each shear pin 25 also passes through a bore 26 in each dowel pin 19 thereby to restrict movement of each dowel pin in the bores 20, 21. The shear pin therefore constitutes a first restraining means between the fuze body 15 and the adaptor 10. The bores 20, 21, are of such a length that spaces 27, 28 are present beneath the respective dowel pins when secured by the shear pins 25. Similarly a space 29 exists between the end face 22 of the adaptor 10 and the annular shoulder 16 which forms a part of the fuze body. This space 29 is, at least in part, taken up by a packing shim 30 which is releasably secured therein.

Formed around the inside of the bore 14 in the centre of the adaptor 10 is a small annular recess 31. A similar annular recess 32 is formed around the fuze body 15 at a height such that when the shear pin 25 is present to restrict relative movement between the fuze body and the adaptor, the two recesses 31, 32 are slightly offset one from the other. A split locking ring 33 of high tensile steel is constrained within the recess 32. The locking ring 33 constitutes the locking member of a second restraining means between the fuze body 15 and the adaptor 10. The natural resilience of the locking ring 33 is such that it will try to expand to a larger radius than that permitted by its abutment with the sides of the bore 14 in the adaptor 10. Hence the locking ring 33 is constantly pressing radially outwardly against the adaptor 10.

Within the fuze body 15 is the mechanism for dispersing the projectiles 7. Schematically shown at 34 is a striker pin and its associated detent means 35. Such strikers and detent means are widely used in projectile fuzes and various alternative will be apparent to those skilled in the art. The detent means may be released by the forces generated during flight or may act on electrical signals received from sensors (not shown). Directly beneath the striker pin 34 is a detonator 36 located in a holder 37 screwed into a bore 38 in the fuze body. Below the detonator 36 is a delayed arming unit shown generally at 39. Delayed arming units are also commonly used in projectile fuzes and many variations in design are available and may be employed without departing from the scope of the invention. The delayed arming unit illustrated comprises a housing 40 with a channel 41 filled with explosive material running longitudinally down its centre. The explosive channel 41 is interrupted by a shutter 42 pivotable about a pin 43 against a biasing means (not shown) such as a spring or wire. The shutter 42 contains a plug 44, also of explosive material, and in a position normally offset from the channel 41.

An explosive initiator charge 45 is located in a recess 46 at the base of the fuze body. Interposed between the bottom of the explosive channel 41 and the initiator charge 45 is a protective septum plate 48 typically of thin steel material.

Below the base of the fuze body and adjacent thereto is a larger dispensing charge 47, typically of gunpowder or other easily combustible composition. The dispersing charge 47 is held in position on a seat 49 formed from a part of the shell casing 2 and which opens into the chamber 6 containing the projectiles 7.

Before the shell 1 is fired, the packing shim 30 is removed so that longitudinal movement between the fuze body 15 and the adaptor 10 is restricted solely by the shear pin 25. The shell 1 may then be fired from a gun by the ignition of a propellant charge (not shown) located at the rear of the shell. The shell accelerates very rapidly in the short time before it leaves the barrel of the gun and these accelerative forces cause the fuze body to 'set back' relative to the adaptor. The fuze body is moved rearwardly with respect to the adaptor into the annular space 29 and forcing the dowel pins 19 to move down the bores 20, 21, fracturing the shear pins 25.

As the fuze body moves rearwardly with respect to the adaptor 10, the two recesses 31 and 32 come into alignment and the locking ring 33 is freed to move outwardly into recess 31 firmly to lock the fuze body and adaptor one to the other. The outward expansion of the locking ring 33 is facilitated by its natural resiliance and is assisted by centrifugal forces generated by the spin imparted to the shell 1 on firing.

The spin of the shell also causes the shutter 42 to pivot about the pin 43 so that the plug 44 aligns with the explosive channel 41 to form a continuous explosive train from the detonator 36. It is only when the shutter 42 has been so pivoted that activation of the detonator 36 will result in the ignition of the initiator charge 45. This reduces the danger that the dispersal charge 47 may be ignited by accidental activation of the detonator 36, eg by means of a sudden jar or jolt.

The dispersal of the projectiles 7 is effected as follows. The detent means 35 is actuated to release the striker pin 34 which impacts and ignites the detonator 36. The detonator in turn ignites the explosive in the channel 41 which transfers the flash through the shutter by means of the plug 44, and burns through the septum plate 48 to ignite the initiator charge 45. The initiator charge 45 burns through the base of the fuze body and ignites the dispersal charge 47.

As the gunpowder dispersal charge 47 burns the pressure in the chamber 6 rapidly increases. The fuze body is locked to the adaptor 10 by means of the locking ring 35 which is of high tensile steel and hence capable of withstanding such a build up of pressure. When the pressure has built up to a sufficient level the plate 3 is blown out, shearing across the screw threads 4 and 5, and the projectiles 7 are ejected from the rear of the shell.

On the advent of a fire wherever the shell is sotred, it is conceivable that the dispersal charge 47 may be ignited without actuation of the above described firing sequence. However without the set back which occurs when the shell is fired from a gun, the fuze body will still be restrained by the shear pins 25 and the recesses 32, 33 will still be offset one from another. This means that the locking ring will still be constrained wholly within the recess 33 and will not be available to lock the fuze body to the adaptor. As the pressure in the chamber 6 increases the shear pins 25 will fracture before the screw threads 4 and 5 on the plate 3 will shear. The whole of the fuze body 15, containing the fuze mechanism heretofore described, is therefore blown out forwardly of the shell 1 to relieve the pressure in the chamber 6. The projectiles 7 remain within the chamber 6 and are not dispersed as distinguished from normal operation of the shell.

Thus even if the carrier shell is involved in a fire, the potential hazard arising from the dispersal and consequent deployment of the secondary projectiles is avoided. Especially where the secondary projectiles are themselves explosive devices it is highly desirable to prevent such deployment. A safety device according to the present invention in the form of a blow out fuze may be fitted to a shell in store unlike many currently employed fuzes which must be fitted immediately prior to firing to ensure maximum safety. The presence of the packing shim 30 prevents undesired priming of the blow out fuze and provides a visual indication that the shell is not armed.

FIG. 2 shows a detail of an alternative embodiment of safety device in the form of a blow out fuze. The fuze body 15 and adaptor 10 of the carrier shell of FIG. 1 are as previously described except in that the shear pin and locking ring 33 constituting the first and second restraining means, are replaced by a dual diameter shear pin 50. The pin 50 comprises a relatively large diameter portion 51 and a relatively small diameter portion 52 joined co-axially thereto at 53. The large diameter portion 51 constitutes the locking member of the second restraining means and is snugly received within a recess 55 provided in the fuze body 15. The recess 55 further contains resilient means in the form of a spring 56 which biases the pin 50 towards the adaptor 10.

The adaptor 10 has a complementary recess 57 of a diameter similar to that of the recess 55 and offset slightly therefrom. The adaptor is further provided with a narrower recess 58 in communication with the recess 57 and forming a shoulder 59 therebetween. The relatively small diameter portion 52 of the shear pin 50 projects into the recess 58 thereby constituting the first restraining means and restricting relative movement between the adaptor 10 and the fuze body 15.

On set back of the fuze body 15 relative to the adaptor 10 on firing of the shell the shear pin 50 is forced in a downward direction relative to the adapter in the sense depicted in FIG. 2. The small diameter portion 52 of the pin 50 is prevented from moving downwardly by contact with the shoulder 59 and the shear pin fractures at the junction 53. The recesses 55 and 57 now align and the large diameter portion 51 is able to move out under the action of the spring 56 (and assisted by the spin of the shell if present) into the recess 57. The smaller diameter portion 52 now detached from the larger portion 51, is forced into the recess 58 by the outward movement of the portion 51. The large diameter portion 51 constituting the second restraining means firmly locks the fuze body and adaptor one to the another thereby to ensure dispersal of the secondary projectiles when the dispersal charge is ignited.

Alternatively, if the dispersal charge is undesirably ignited before firing of the shell, the shear pin is forced upwardly relative to the adaptor in the sense of FIG. 2, fracturing the small diameter portion 52 at the joint 53. The fuze body 15 may therefore be blown out forwardly of the shell as previously described.

FIG. 3 shows an alternative embodiment of safety device for use as a fuze in a spin stabilized shell. In this embodiment the requirement for one section of the shell to set back relative to another is eliminated. In FIG. 3 the adaptor 10 and fuze body 15 are shown as before, the fuze body having a recess 60 in which is snugly received a dual diameter shear pin 50. The pin 50 comprises a larger diameter portion 51 constituting the locking member of the second restraining means, and received wholly within the recess 60, and a smaller diameter portion 52 constituting the first restraining means, projecting into a complementary recess 61 provided in the adaptor 10. The recess 61 is the same diameter as that of recess 60 and is located in alignment therewith. At the far end of the small diameter portion 52 is attached a collar 62 against which acts holding means in the form of a spring 63 which holds the pin 50 in the recess 60 in the fuze body.

As with the embodiment described in FIG. 2, should the dispersal charge be undesirably ignited before the shell is fired, the pin 50 fractures across the small diameter portion 52 and the fuze body 15 is blown out forwardly of the shell. However, the shear strength of the small diameter portion is sufficient for it to withstand the set back of the fuze body 15 on firing of the shell. The centrifugal forces generated by the spin of the shell on firing counteract the holding force of the spring 63 and move the pin 50 outwardly and further into the recess 61. This brings the larger diameter portion 51 out of the recess 60 to lock the fuze body and adaptor one to the other and permit dispersal of the projectiles as previously described.

An alternative embodiment of safety device using spin of the shell to actuate the locking mechanism is shown in FIG. 4. The fuze body 15 and adaptor 10 are joined by a shear pin 70 of uniform diameter snugly received in recesses 71 and 72 and constituting the first restraining means. A separate, larger diameter shear pin 73 constituting the locking member of the second restraining means is received within a recess 74 in the fuze body. The shear pin 73 is restrained from moving outwardly by holding means in the form of a spring 75 contained within a complementary recess 76 opposite and adjacent in the adaptor 10.

Operation of this embodiment is similar to that of the embodiment of FIG. 3. Although the shear pin 70 is capable of withstanding set back of the fuze body, ignition of the dispersal charge without the spin necessary to actuate the larger diameter shear pin 73 results in fracture of the pin 70 and the fuze body 15 is blown out. Centrifugal forces generated by the spin of the shell on firing however, move the larger diameter pin 73 against the holding action of the spring 75 and into the recess 76, thereby to lock the fuze body relative to the adaptor and permit dispersal of the projectiles. It should be noted that the larger diameter pin 73, when restrained by the spring, should be flush with the interface between the adaptor 10 and fuze body 15. The spring must not project into the recess 74 and become sheared when the fuze body is blown out, possibly even preventing proper release thereof.

FIGS. 5 and 8 show a further embodiment of safety device actuated by the spin of the shell. FIGS. 5 and 7 show the shell before firing with the fuze body capable of being blown out of the dispersal charge. A locking ring shown generally at 80 consists of two arcuate halves 81, 82, connected by thin wires 83 which prevent the halves from straightening under their natural resilience. Thus the locking ring 80 is contained wholly within a recess 84 in the fuze body 15. This allows easy fracture of the shear pin 70 and release of the fuze body should the dispersal charge be undesirably ignited.

On firing of the shell, centrifugal forces due to its spin cause the wires 83 to break permitting relaxation of the two halves 81, 82. The halves are then free to expand outwardly into a recess 85 in the adaptor 10 as shown in FIGS. 6 and 8. This locks the fuze body and adaptor one to another and permits dispersion of the projectiles as previously described.

I claim:

1. A carrier shell for carrying and dispersing a plurality of secondary projectiles comprising:

a shell casing having a venting aperture defined therein;

a plurality of secondary projectiles contained within the casing;

an explosive dispersal charge contained within the casing for dispersing the secondary projectiles from the casing after firing and venting only through said venting aperture in the event of explosion prior to firing from the shell of a gun;

a safety device having a body which closes the venting aperture;

first restraining means including a first mechanical means for securing the body to the shell casing and having a strength such that it will yield on detonation of the explosive charge; and second restraining means having an operative and an inoperative condition, said second restraining means being ineffective to secure the body to the shell casing when in the inoperative condition, said second restraining means including a second mechanical means effective to secure the body to the shell casing when in the operative condition, said second mechanical means having a strength such that it will not yield on detonation of the explosive dispersal charge, said second restraining means being responsive only to forces generated on firing the shell from a gun to move from the inoperative to the operative condition.

2. A carrier shell according to claim 1 wherein the said first mechanical means comprises a shear pin.

3. A carrier shell according to claim 2 wherein the shear pin is formed of aluminium.

4. A carrier shell according to claim 1 wherein the second restraining means comprises first and second recesses, formed one in the body of the safety device and the other in the shell casing, and a locking member constrained within the first recess and actuable to move into the second recess to lock the body and casing one to the other.

5. A carrier shell according to claim 4 wherein the locking member is formed of high tensile steel.

6. A carrier shell according to claim 4 wherein the first and second recesses are longitudinally offset one from the other when the second restraining means is in the inoperative condition, and relative movement between the body and the shell casing in response to set back forces generated on firing the shell from the gun causes the two recesses to align, permitting movement of the locking member into the second recess to secure the body and the shell casing one to the other.

7. A carrier shell according to claim 6 wherein the first and second recesses are of annular form and the locking member is a split ring of a resilient material, the resilience of the locking member being such as to bias the locking member towards the second recess.

8. A carrier shell according to claim 6 wherein the first and second recesses are formed as bores, and the locking member is a shear pin.

9. A carrier shell according to claim 8 including resilient means for biasing the locking member towards the second recess.

10. A carrier shell according to claim 8 wherein the first restraining means comprises a sheer pin integral with the shear pin constituting the locking member.

11. A carrier shell according to claim 1 wherein the second restraining means is moveable from said inoperative condition to said operative condition in response to set back forces generated on firing the shell from the gun so as to exceed a predetermined forward linear acceleration.

12. A carrier shell according to claim 11 wherein the body of the safety device is moveable relative to the shell casing in response to the shell exceeding a predetermined forward linear acceleration, thereby to actuate the second restraining means.

13. A carrier shell according to claim 4 wherein the first and second recesses are initially aligned one with the other and means are provided for holding the locking member in the first recess.

14. A carrier shell according to claim 13 wherein the first and second recesses are formed as bores and the locking member is a shear pin.

15. A carrier shell according to claim 14 wherein the holding means comprises a resilient bias opposing movement of the locking member into the first recess.

16. A carrier shell according to claim 14 wherein the first and second restraining means are separate members.

17. A carrier shell according to claim 14 wherein the first restraining means a shear pin integral with the shear pin constituting the locking member.

18. A carrier shell according to claim 17 wherein the first restraining means carries a guide member which locates in the second recess, thereby to maintain alignment of the first and second recesses.

19. A carrier shell according to claim 13 wherein the first and second recesses are of annular form and the locking member is a ring comprising arcuate portions of resilient material conjoined by weakened portions breakable to actuate the second restraining means.

20. A carrier shell according to claim 13 wherein the second restraining means is actuable in response to the shell exceeding a predetermined angular velocity.

21. A carrier shell according to claim 1 wherein the body of the safety device is that of the fuze of the carrier shell.

22. A carrier shell according to claim 1 wherein there is provided an adaptor, located between the body of the safety device and the shell casing, and adapted to receive the first and second restraining means.

* * * * *